US010946386B2

(12) United States Patent
Pischtschan et al.

(10) Patent No.: US 10,946,386 B2
(45) Date of Patent: Mar. 16, 2021

(54) ROLLER MILL AND METHOD FOR CONTROLLING A ROLLER MILL

(71) Applicant: ABB Schweiz AG, Baden (CH)

(72) Inventors: Martin Pischtschan, Birmenstorf (CH); Hans-Ulrich Hirt, Zetzwil (CH)

(73) Assignee: ABB Schweiz AG, Baden (CH)

( * ) Notice: Subject to any disclaimer, the term of this patent is extended or adjusted under 35 U.S.C. 154(b) by 706 days.

(21) Appl. No.: 15/346,296

(22) Filed: Nov. 8, 2016

(65) Prior Publication Data

US 2017/0050188 A1 Feb. 23, 2017

Related U.S. Application Data

(63) Continuation of application No. PCT/EP2015/060196, filed on May 8, 2015.

(30) Foreign Application Priority Data

May 8, 2014 (EP) ..... 14167575

(51) Int. Cl.
*B02C 4/42* (2006.01)
*B02C 4/02* (2006.01)
*B02C 25/00* (2006.01)

(52) U.S. Cl.
CPC ..... *B02C 4/42* (2013.01); *B02C 4/02* (2013.01); *B02C 25/00* (2013.01)

(58) Field of Classification Search
CPC .. B02C 4/02; B02C 4/42; B02C 4/286; B02C 4/36; B02C 4/32; B02C 25/00
USPC ..... 241/35, 36, 235, 236, 286
See application file for complete search history.

(56) References Cited

U.S. PATENT DOCUMENTS

2008/0307939 A1* 12/2008 Smith ..... B26D 5/00 83/331
2009/0188360 A1* 7/2009 Ishibuchi ..... B26D 1/626 83/342
2012/0175443 A1* 7/2012 Neunzert ..... B02C 18/142 241/30
2016/0185063 A1* 6/2016 Wilburn ..... B30B 11/18 264/40.1

(Continued)

OTHER PUBLICATIONS

European Patent Office, International Search Report issued in corresponding Application No. PCT/EP2015/060196, dated Jul. 14, 2015, 3 pp.

(Continued)

*Primary Examiner* — Kenneth E Peterson
*Assistant Examiner* — Nhat Chieu Q Do
(74) *Attorney, Agent, or Firm* — Taft Stettinius & Hollister LLP

(57) ABSTRACT

The subject matter of the invention is a roller mill comprising two rollers which are arranged in parallel, are pressed one against the other and rotate in opposite directions, wherein one of the rollers can be displaced orthogonally with respect to the axial direction of this roller, and two drives, which drives are each assigned to one of the two rollers, and each have an electric motor, a master of the electric motors predefines for the electric motors a setpoint value for the rotational speed of the torque as a reference, and a reference of a follower electric motor of the electric motors comprises the actual value of the torque or of the rotational speed of the master electric motor multiplied by a load distribution factor.

6 Claims, 6 Drawing Sheets

(56) References Cited

U.S. PATENT DOCUMENTS

2016/0199842 A1* 7/2016 Barber ..... B02C 1/02
241/207

OTHER PUBLICATIONS

European Patent Office, Search Report issued in corresponding Application No. 114167575.1, dated Sep. 16, 2014, 2 pp.
Jones, "VFD Control Methodologies in High Pressure Grinding Drive Systems," Cement Industry Technical Conference, 2012, 7 pp.

* cited by examiner

ROLLER MILL AND METHOD FOR CONTROLLING A ROLLER MILL

TECHNICAL FIELD

The present invention relates to the field of roller mills. It relates to a roller mill having two rollers which rotate in opposite directions during operation and which are rotatably mounted in a frame, and to a method for controlling such a roller mill.

PRIOR ART

Roller mills are used to mill materials, in particular ores and cement. Roller mills typically have a roller diameter of 0.8 to 3 meters and a driving power of 0.2 to 5 megawatts. They are particularly energy-efficient compared to other types of mill. Such a roller mill is described, for example, in DE 4028015 A1.

FIG. 1 shows a schematic illustration of a radial section for a roller mill from the prior art. The roller mill comprises two rollers 1, 1 which rotate in opposite directions, which rollers 1, 1' are rotatably mounted horizontally and in parallel with one another in a frame (not illustrated). One of the two rollers 1 can be displaced orthogonally here with respect to the axial direction of this roller 1. As a rule, the other of the two rollers 1' cannot be displaced orthogonally. The displaceable roller 1 is pressed by a spring system (not illustrated) onto the fixed roller 1'. Each roller 1, 1' has a milling face. The milling faces of the rollers 1, 1' which lie opposite one another form a wedge. Material is filled into the wedge from above between the rollers 1, 1', is led downward by the rotation of the rollers 1, 1' and is comminuted by the wedge and the associated pressure on the material. The rotation of the rollers 1, 1' is provided by means of a drive (not illustrated). Known drives for roller mills usually have two electric motors, wherein in each case one electric motor is connected to one of the rollers and drives it.

FIG. 2 shows a roller mill with two drives from the prior art. In each case one drive is assigned to one of the rollers 1, 1' and comprises in each case an electric motor 2, 2', a cardan shaft 3 and a planetary gear mechanism 4. The connection of the radially displaceable roller 1 to the positionally fixed electric motor 2 is made via the cardan shaft 3.

It is also optionally possible for the cardan shaft to directly adjoin the shaft of the displaceable roller and for the planetary gear mechanism to be arranged between the cardan shaft and the electric motor. In such an arrangement, as described, for example, in DE 102011000749 A1, the planetary gear mechanism of the displaceable roller is also positionally fixed in addition to the electric motor. It is also optionally possible for an electric motor to supply the desired rotational speed for the rollers directly without rotational speed adaptation of a gear mechanism, for example by controlling the electric motor by means of a frequency converter. In this case, the drive does not comprise a gear mechanism, and the electric motor is connected directly to the roller via the cardan shaft. The electric motors of the two rollers are usually controlled by means of two separate frequency converters. It is also optionally possible for a direct drive to be arranged on the roller itself. In this case, the drive does not comprise a cardan shaft.

The control strategies for the drives have an influence on the wear of the rollers. In general, the wear of the rollers is influenced inter alia by the contact pressure of the rollers, the circumferential speed of the milling faces of the individual rollers and the difference between the circumferential speeds of the milling faces of the rollers. The wear of the two rollers is usually of differing degrees. The displaceable roller and the fixed roller can both have a relatively high degree of wear. The following control strategies for controlling the drives of a roller mill are known from the article "VFD control methodologies in High Pressure Grinding drive systems" (Brent Jones, Cement Industry Technical Conference, 2012 IEEE-IAS/PCA 53).

In the first strategy, an identical setpoint value for the rotational speed is predefined as a reference to the control of the two motors. Both frequency converters attempt to set the same rotational speed for the motor controlled by them, but they act independently of one another in order to achieve this goal. It is problematic here that in the case of frequency converters of identical design the rotational speed controls have an error such that an identical rotational speed of the two rollers cannot be achieved in this way and therefore a difference arises in the circumferential speeds of the milling faces of the two rollers. In addition it is problematic that the diameter of the roller is not taken into account. In the case of different roller diameters such as, for example, as a result of increased wear on one of the two rollers, even an identical rotational speed of the two rollers gives rise to different circumferential speeds of the milling faces of the rollers. A further consequence of this is that the load between the two rollers is not equally distributed and there is therefore a relative rotation of the two rollers with respect to one another, which in turn gives rise to increased wear.

In the second strategy, an identical setpoint value for the torque is predefined for the control of the two motors. It is problematic here that in the event of the drive torque being higher than the load torque, the roller mill will accelerate, or in the inverse case, be decelerated. This results in an alternating rotational speed of the roller mill in proportion to variations in the milled material which is also disadvantageous for the operation of the roller mill.

In the third strategy, one of the electric motors is defined as a master and the other electric motor as a follower.

FIG. 3 shows a schematic illustration of the signal flow in a roller mill with this third control strategy from the prior art in an initial phase. As in the first control strategy, an identical setpoint value for the rotational speed 61 is predefined as a reference to the two frequency converters 5, 5'. Both frequency converters 5, 5' are regulated with respect to the rotational speed.

FIG. 4 shows a schematic illustration of the signal flow in the roller mill from FIG. 3 in a production phase. After a defined load threshold has been reached or by means of manual switching over, the setpoint value for the rotational speed 61 is no longer predefined, but instead an actual value of a torque 62 of the electric motor 2 (master) connected to the other frequency converter 5 is predefined, as a reference to one of the frequency converters 5' (follower). The frequency converter 5' of the follower electric motor 2' is as a result no longer regulated with respect to the rotational speed but rather with respect to the torque. The frequency converter 5 of the master electric motor 2 also remains rotational-speed-regulated in the production phase. This permits more equalized distribution of the loads between the two rollers and a reduction in the difference between the two circumferential speeds of the milling faces of the rollers and brings about a reduction in the different wear of the rollers.

The master and follower can be assigned to the displaceable or the fixed roller as desired. Optionally, in the master-follower strategy it is also possible to use the actual value of a rotational speed of the master electric motor 2 (speed follower) as a reference for the control of the follower electric motor 2' in the production phase instead of the actual value of the torque of the master electric motor 2 (torque follower). In this case, in the initial phase an identical setpoint value the torque is predefined as a reference to both frequency converters 5, 5', and after the switching over into the production phase the actual value of the rotational speed of the master electric motor 2 is predefined as a reference to the frequency converter 5' of the follower electric motor 2'. In the master-follower strategy it is problematic that the wear can be optimized only for each roller individually with respect to its service life. It is not possible to optimize the wear of both rollers in the total system of the roller mill in order to maximize the service life of the roller mill in this way.

SUMMARY OF THE INVENTION

The object of the present invention is to specify a roller mill which has an increased service life.

This object is achieved by means of a roller mill having the features of patent claim 1. Preferred embodiments are the subject matter of the dependent patent claims.

In a roller mill having two rollers which are arranged in parallel, are pressed one against the other and rotate in opposite directions during operation and two electric motors, in each case one motor is connected to one roller and drives the respective roller during operation. One of the rollers can be displaced orthogonally with respect to the axial direction of this roller. Roller mills are also referred to as roller presses, material bed roller mills or high pressure grinding rolls. The two electric motors each have a controller, which permits specific operating parameters to be set at the respective electric motor. In an extreme case, the controller of one of the electric motors can be simplified as a direct connection to an electric power supply network if the other of the electric motors can be controlled independently of the electric power supply network. As a result of the direct connection to the electric power supply network, the operating parameters of the directly connected electric motor are set in accordance with the parameters of the electric power supply network, such as, for example, the frequency and the voltage. As a result of the condition requiring independent controllability of the other electric motor in this extreme case, despite the dependence of the directly connected motor on the generally constant electric power supply network, relative control of the motors with respect to one another is possible. One of the electric motors is defined as a master, and the other of the electric motors is defined as a follower. In this context, the master and the follower can be assigned with respect to the displaceable or non-displaceable roller as desired. In the extreme case in which the controller of one of the electric motors is simplified to a direct connection to an electric power supply network, the electric motor which can be controlled independently of the electric power supply network has to be the follower. A setpoint value for the rotational speed or the torque of the master electric motor is transferred as a reference or target value of the control to the first controller of the master electric motor. An actual value of the torque or of the rotational speed of the master electric motor which results from the control of the master electric motor is multiplied by a load factor in a multiplier. The load distribution factor is a real number between 0 and infinite, preferably without the value 1, particularly preferably in a range between 0.8 and 1.2. The value which arises as a result of the multiplication is used for the determination of a reference or target value of the second controller for the follower electric motor. The use can in the simplest case be the direct use of the value, arising through the multiplication, as a reference. However, it is also possible for the value arising as a result of the multiplication to be processed even further and possibly also combined with another signal. As a result of the load distribution factor, the individual wear of the rollers can be influenced, and the load can be distributed between the two rollers in a targeted manner.

In one preferred embodiment, the actual value of the master electric motor which is multiplied by the load distribution factor is combined with the setpoint value for the rotational speed or the torque, which setpoint value serves as a reference for the control of the master electric motor, by means of addition of the signals. As a result, the influence of the load distribution is limited to small effects on the setpoint value.

BRIEF DESCRIPTION OF THE FIGURES

The invention will be explained in more detail below using exemplary embodiments and with reference to the figures.

In the drawings.

Reference symbols used in the drawings are summarized in the list of reference symbols. Basically, identical parts are provided with the same reference symbols.

WAYS OF IMPLEMENTING THE INVENTION

Figure 5:
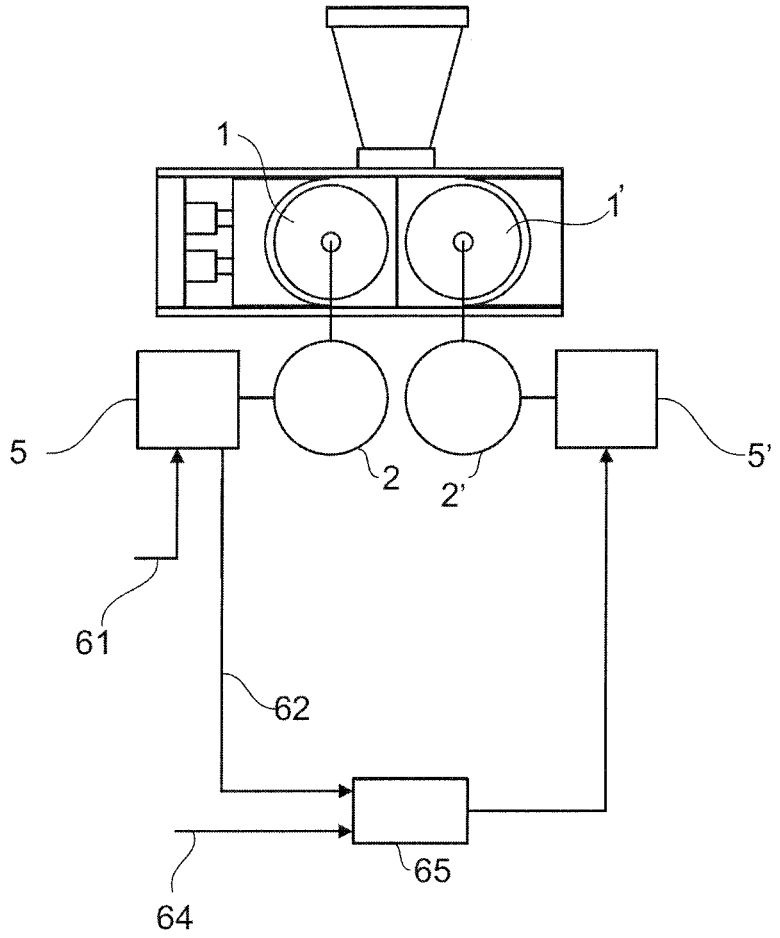
FIG. 5 shows a schematic illustration of the signal flow in a roller mill according to the invention in a first exemplary embodiment.

FIG. 5 shows a schematic illustration of the signal flow in a roller mill according to the invention in a first exemplary embodiment. A superordinate control, for example by means of direct inputting of the operator or by means of a distributed control system (DCS), predefines a setpoint value 61 as a reference for the rotational speed to a frequency converter 5 of a master electric motor 2. An actual value 62, resulting from the regulation of a rotational speed regulator (not illustrated) of the frequency converter 5 of the master electric motor 2, of the torque of the master electric motor 2 is multiplied by a load distribution factor 64 in a multiplier 65. The load distribution factor 64 can be defined, for example, by manual inputting by the operator or regulation of the load distribution factor 64, intended therefor, which input or regulation can optionally also include additional measurement values such as, for example, the roller diameter. A value which results therefrom is transferred as a setpoint value to a torque regulator (not illustrated) of a frequency converter 5' of a follower electric motor 2'. The wear of the individual rollers in relation to one another can be influenced by the load distribution factor 64.

Figure 1:
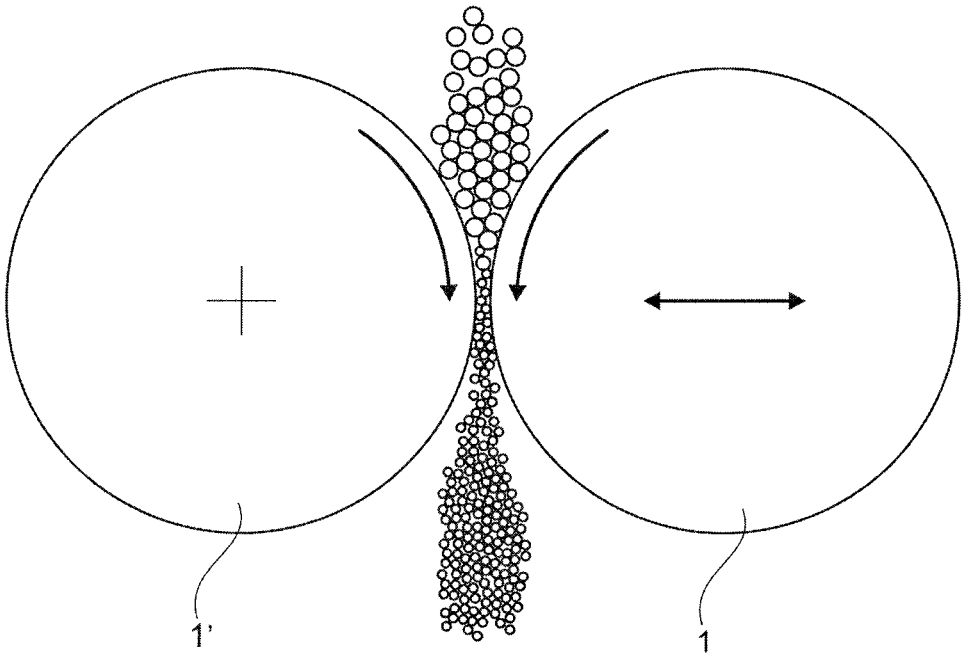
Fig. 1 Prior Art
FIG. 1 shows a schematic illustration of a radial section of a roller mill from the prior art.
Figure 2:
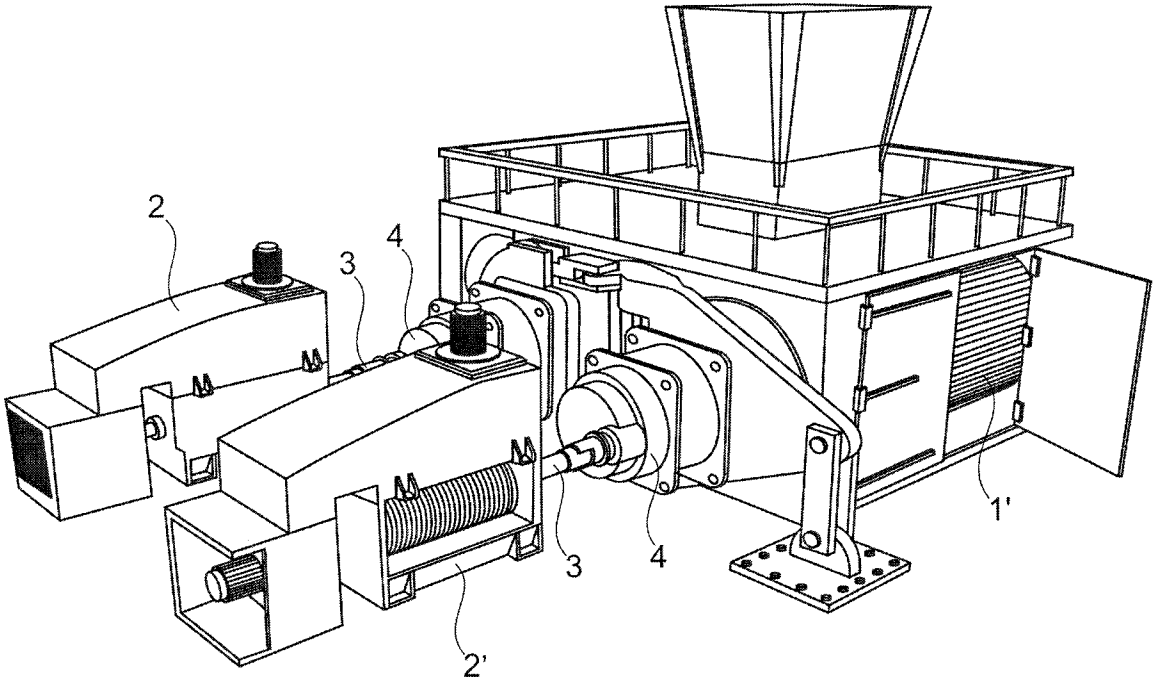
Fig. 2 Prior Art
FIG. 2 shows a roller mill with two drives from the prior art.
Figure 3:
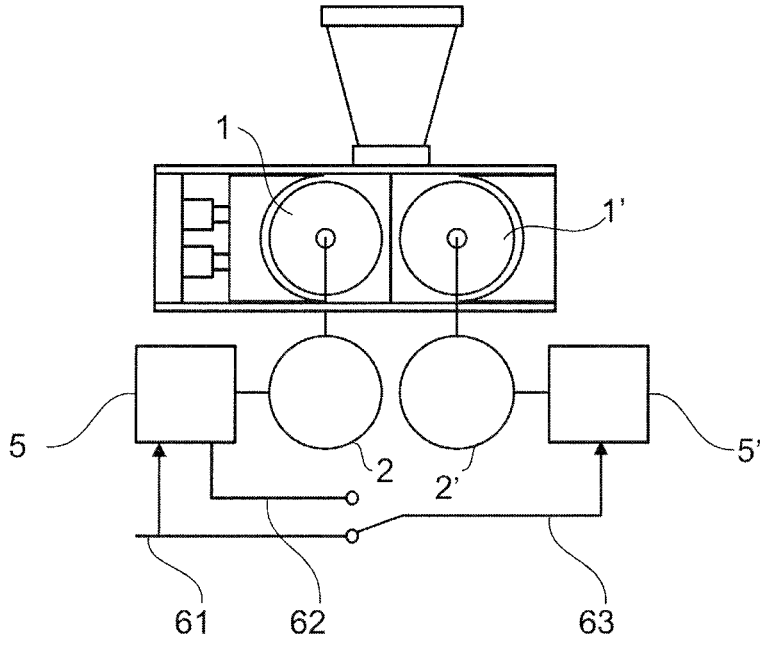
Fig. 3 Prior Art
FIG. 3 shows a schematic illustration of the signal flow in a roller mill with a master-follower control from the prior art in an initial phase.
Figure 4:
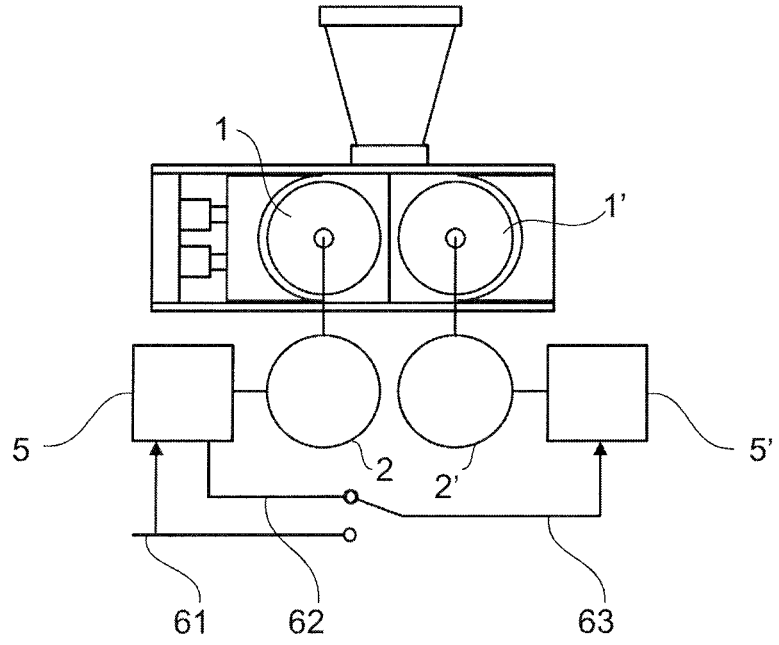
Fig. 4 Prior Art
FIG. 4 shows a schematic illustration of the signal flow in a roller mill with a master-follower control from the prior art in a production phase.

Analogously to FIG. 3, it is also possible that in an initial phase until a defined load threshold is reached or by manual switching over to predefine as a reference the identical setpoint value for the rotational speed to the two frequency converters. Both frequency converters are therefore regulated with respect to the rotational speed in the initial phase. It is optionally also possible for the system to be configured as a speed follower. In this context, instead of the actual value of the torque of the master electric motor in the case of the torque follower, the actual value of a rotational speed of the master electric motor is used as a reference for the follower electric motor in the production phase. Therefore, the value which is obtained after the multiplication by the load distribution factor is also a rotational speed value which is then predefined as a reference to the frequency converter of the follower electric motor. It is possible to predefine, as two variations of the speed follower concept, a setpoint value for the rotational speed and alternatively a setpoint value for the torque as reference for the control of the master electric motor.

Figure 6:
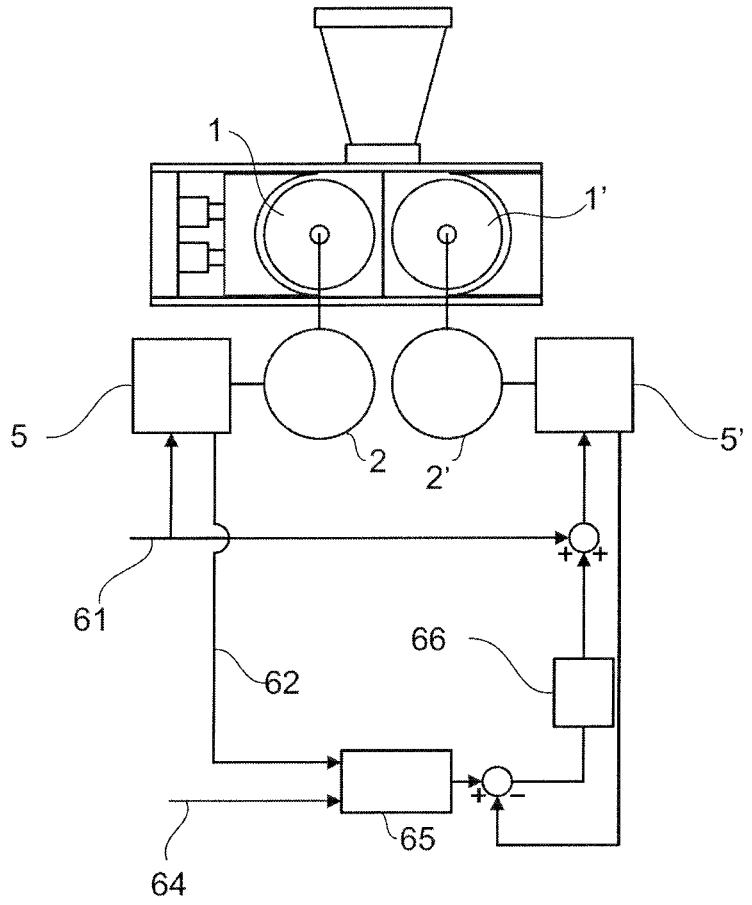
FIG. 6 shows a schematic illustration of the signal flow in a roller mill according to the invention in a second exemplary embodiment.

FIG. 6 shows a schematic illustration of the signal flow in a roller mill according to the invention in a second exemplary embodiment. In addition to FIG. 5, feedback of the actual value of the torque of the follower electric motor 2' is present. The setpoint value of the torque of the follower electric motor 2' from the multiplication by the load distribution factor is compared with the actual value of the torque of the follower electric motor 2' by means of a subtraction. The difference which is formed in this way between the setpoint value and the actual value of the torque of the follower electric motor 2' is transferred to a regulator 66, which regulator 66 can be, for example, a PID regulator. The regulator 66 regulates the difference of the torque of the follower electric motor 2' and converts the regulated signal into a rotational speed value using the area moment of inertia of the roller 1' which is connected to the follower electric motor 2'. This direct coupling between the torque and the rotational speed is ensured by the mechanical coupling of the rollers by means of the material in the milling gap. As a result of the mechanical coupling of the two rollers, increasing the circumferential speed of one roller gives rise to an additional force which acts tangentially on the second roller and reduces the required force or torque in order to maintain or increase the circumferential speed of the second roller to the same degree. In this context, the ratio between the two roller radii corresponds to the transmission ratio in a gear mechanism with a transmission ratio in the vicinity of 1. The output of the regulator 66 is added to the original setpoint value 61 for the rotational speed and then transferred as a setpoint value to the frequency converter of the follower electric motor 2'.

Analogously to FIG. 5, an optional initial phase or a refinement as a speed follower are also possible in both variants in FIG. 6. In the variant of the speed follower in which a setpoint value is predefined for the rotational speed as a reference for the control of the master electric motor, the conversion of the regulator using the area moment of inertia is eliminated, the the signals relate to rotational speed values with the exception of the load distribution factor.

Figure 7:
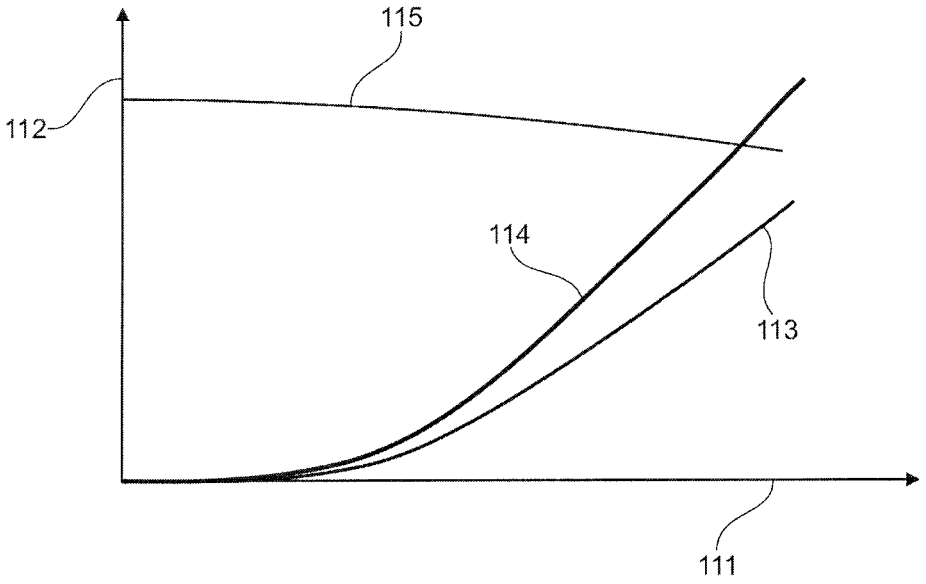
FIG. 7 shows an exemplary relationship between the wear of two rollers and the selection of a load distribution factor.

FIG. 7 shows an exemplary relationship between the wear of two rollers and the selection of a load distribution factor 115. In the diagram, the wear 112 of a roller, in the form of the reduction in the roller diameter, is plotted against the rotational work 111 already performed by this roller. The rotational work 111 is to be understood here as being the cumulated torque, necessary for the milling of the previously milled material, plotted against the time required for the milling. The two curves 113, 114 represent the wear 112 of two rollers of a pair of rollers as a function of the rotational work 111. The curve 114 shows a greater degree of wear of the corresponding roller than the wear of the roller illustrated in the curve 113. In the illustrated case, the load factor 115 is then selected such that the roller with the accumulated greater previous wear bears a smaller part of the load necessary for the milling.

In general, the load distribution factor can be a positive real number including zero. In the case of identical accumulated wear of the two rollers, the load distribution factor should assume the value of one. The greater the difference between the accumulated wear values of the two rollers, the further the corresponding load distribution factor is away from the value of one. Depending on which of the two rollers has a greater degree of wear, the value of the load distribution factor tends toward zero here or toward infinity. In practice, the load distribution factor tends to vary between 0.8 and 1.2.

In the preceding case, the objective is to achieve, during the selection of the load factor, as far as possible the same wear of the rollers of a pair of rollers, in order, for example, to exchange both rollers in a maintenance operation and to maximize the time between two maintenance operations. However, other objectives when selecting the load distribution factor are also possible, such as, for example, the greater degree of wear of the roller which has already worn to a greater degree, and the protection of the roller which has worn to a lesser degree. Furthermore, it is ensured that the energy required is minimized, since, in particular in comparison with the solution in which both motors are provided with the same rotational speed references, it is ensured that only the energy required for milling is supplied.

LIST OF REFERENCE NUMBERS

1 Displaceable roller
1' Fixed roller
2 Master electric motor
2' Follower electric motor
3 Cardan shaft
4 Planetary gear mechanism
5 Frequency converter of the master electric motor
5' Frequency converter of the follower electric motor
61 Setpoint value of the rotational speed
62 Actual value of the master electric motor
63 Reference for follower electric motor
64 Load distribution factor
65 Multiplier
66 Regulator
111 Rotational work of a roller
112 Wear of a roller
113 Curve of the displaceable roller
114 Curve of the fixed roller
115 Curve of the load distribution factor

The invention claimed is:

1. A roller mill for milling materials including ores and cement, comprising two rollers which are arranged in parallel, are pressed one against the other and rotate in opposite directions during operation in order to mill the material between the two rollers, wherein one of the rollers can be displaced orthogonally with respect to an axial direction of the one of the rollers, a master electric motor and a follower electric motor, the master electric motor driving one of the rollers and the follower electric motor driving another of the rollers, a first controller of the master electric motor configured to receive a setpoint value for a rotational speed or a torque as a first reference for a control of the master electric motor, the first reference being a target value of the control, a multiplier configured to multiply an actual value of the torque or of the rotational speed of the master electric motor by a load distribution factor, the load distribution factor being a variable value selected for influencing a wear difference of the two rollers, and a second controller of the follower electric motor configured to receive a second reference for a control of the follower electric motor, the second reference being a target value of the control, the second reference being based on a value which arises as a result of multiplication of the multiplier, wherein the load distribution factor is different from 1 at least part of the time such that the torque or the rotational speed of the master electric motor and the follower electric motor are different from each other and the wear caused by the material milled between the two rollers is varied.

2. The roller mill as claimed in claim 1, wherein the load distribution factor is defined by means of an operator of the roller mill.

3. The roller mill as claimed in claim 1, wherein the actual value of the master electric motor multiplied by the load distribution factor with the multiplier is compared with a corresponding actual value of the follower electric motor via a subtraction with a subtraction unit, and wherein the reference for the control of the follower electric motor is based on the setpoint value and a value resulting from the subtraction.

4. The roller mill as claimed in claim 3, wherein the compared value is regulated by means of a regulator.

5. A roller mill for milling materials including ores and cement, comprising two rollers which are arranged in parallel, are pressed one against the other and rotate in opposite directions during operation in order to mill the material between the two rollers, wherein one of the rollers can be displaced orthogonally with respect to an axial direction of the one of the rollers, a master electric motor and a follower electric motor, the master electric motor driving one of the rollers and the follower electric motor driving another of the rollers, a first controller of the master electric motor configured to receive a setpoint value for a rotational speed or a torque as a first reference for a control of the master electric motor, the first reference being a target value of the control, a multiplier configured to multiply an actual value of the torque or of the rotational speed of the master electric motor by a load distribution factor, the load distribution factor being a variable value selected for influencing a wear difference of the two rollers, and wherein the actual value of the torque or of the rotational speed of the master electric motor multiplied by the load distribution factor with the multiplier is compared with a corresponding actual value of the follower electric motor via a subtraction with a subtraction unit; and a second controller of the follower electric motor configured to receive a second reference for a control of the follower electric motor, the second reference being a target value of the control, the second reference being based on a value which arises as a result of the subtraction with an addition of the first reference, wherein the load distribution factor is different from 1 at least part of the time such that the torque or the rotational speed of the master electric motor and the follower electric motor are different from each other and the wear caused by the material milled between the two rollers is varied.

6. The roller mill as claimed in claim 5, wherein the value which arises as a result of the subtraction is regulated via a regulator, whereupon the first reference is added.

* * * * *